United States Patent [19]

Fujii

[11] 4,090,709

[45] May 23, 1978

[54] STRUCTURE FOR PREVENTING REMOVAL OF GRIP COVERS FROM METALLIC BATS

[76] Inventor: Hirokazu Fujii, No. 19-9,2-chome, Obiraki, Fukushima-ku, Osaka, Japan

[21] Appl. No.: 620,215

[22] Filed: Oct. 6, 1975

[51] Int. Cl.[2] ..... A63B 59/06

[52] U.S. Cl. ..... 273/72 A; 29/526 R; 29/505; 29/520; 29/522 R

[58] Field of Search ..... 273/67 A, 67 DA, 68, 273/70, 72 R, 72 A, 73 J, 75, 81 R, 82 B, 80.2–80.8; 43/23; 145/61 R; 74/551.8, 551.9, 558, 558.5; 280/11.37 H; 135/54, 64; 403/318, 378, 379; 85/5 CP, 5 E, 5 M, 8.3, 8.9, 9 W

[56] References Cited

U.S. PATENT DOCUMENTS

| | | | |
|---|---|---|---|
| 1,212,038 | 1/1917 | Flaxman | 273/81 R X |
| 2,603,260 | 7/1952 | Floren | 273/73 J X |
| 3,170,691 | 2/1965 | Pritchard | 273/80.5 |
| 3,633,910 | 1/1972 | Spenle | 273/73 J |
| 3,697,069 | 10/1972 | Merola | 273/72 A |
| 3,779,551 | 12/1973 | Wilson | 273/72 A |
| 4,000,895 | 1/1977 | Scott | 273/72 A |

FOREIGN PATENT DOCUMENTS

| | | | |
|---|---|---|---|
| 1,473,295 | 2/1967 | France | 43/23 |
| 307,610 | 3/1929 | United Kingdom | 403/379 |
| 1,144,628 | 3/1969 | United Kingdom | 273/81 R |

*Primary Examiner*—Richard J. Apley
*Attorney, Agent, or Firm*—Browdy and Neimark

[57] ABSTRACT

By covering a grip of a metallic bat with a grip cover made of hard rubber and forcing at least one pin or cotter to penetrate through grip end and the grip, the metallic bat of the present invention can avoid the disadvantage of conventional metallic bats whereby the grip may become removed and fly out from the grip cover to cause an unforeseen accident on swinging the bat. It is thus possible to provide a safe and functional metallic bat.

2 Claims, 4 Drawing Figures

STRUCTURE FOR PREVENTING REMOVAL OF GRIP COVERS FROM METALLIC BATS

The present invention relates to metallic bats which have been widely used increasingly in baseball.

Wooden bats have lately been substituted by metallic bats, owing to their durability. These metallic bats are conventionally made of aluminum or light alloys such as juralmin. Metallic bats are hollow throughout their total length, and are lighter and much stronger than wooden bats.

As used in the present specification and claims, the end of the bat is defined as head, the portion which is grasped by hands as the grip, and the end of the grip which is ellipsoid-shaped to prevent the hands from slipping as the grip end.

In metallic bats, grip covers are conventionally used composed of a grip cover portion which covers the above-mentioned grip for preventing slipping and a grip end. The grip cover is integrally molded with hard rubber, which is adhered to the surface of the grip with adhesives.

As the grip is only adhered to the grip cover with adhesives, the grip is apt to be removed and to fly out from the grip cover to cause unforeseen accidents on swinging the bat. This trouble has become a problem in baseball.

An object of the present invention is to avoid such disadvantages and to provide a complete metallic bat on which the grip is revented from being removed from the grip cover.

Figure 1:
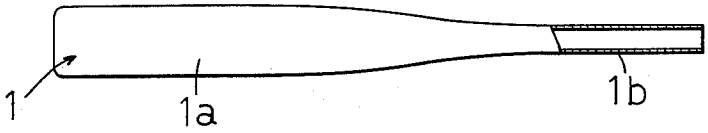
FIG. 1 is an elevation, partly in section, of a metallic bat body.

Referring to the drawings, numeral 1 is a hollow tubular bat body, which is conventionally made of aluminum or juralmin, depending on the balls to be used. Numeral 1*a* represents the head, and numeral 1*b*, the grip. The end of the grip 1*b* is only cut off without working.

Figure 2:
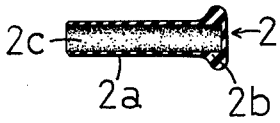
FIG. 2 is a sectional view of the grip cover.
Figure 3:
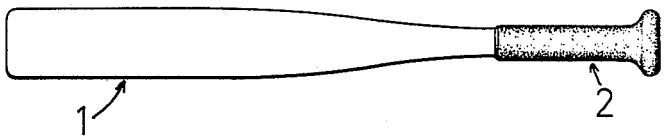
FIG. 3 is an elevation of the metallic bat.

The grip cover 2 covering the grip 1*b*, as illustrated in FIG. 2, consists of grip cover portion 2*a* having an inside diameter of sufficient magnitude to insert the grip 1*b* into inner part 2*c*, and having an approximately ellipsoid-shaped grip end 2*b* provided at the end of the cover 2*a*. The grip cover 2 is integrally molded with hard rubber.

Figure 4:
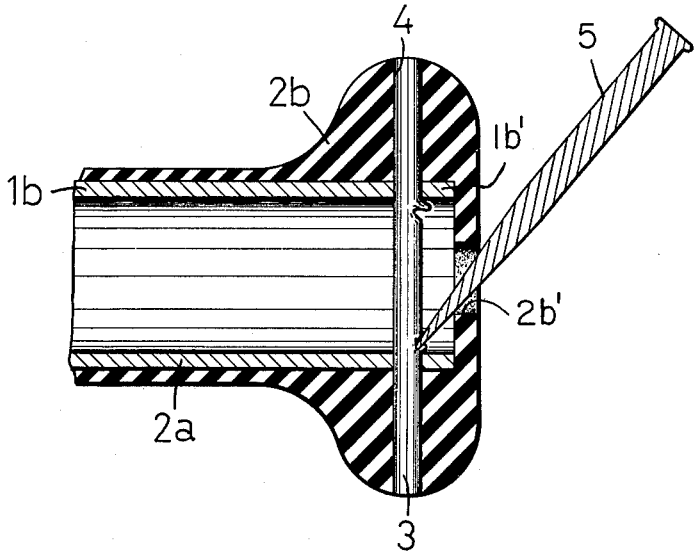
FIG. 4 is a sectional view of the grip cover, attached to the grip.

In the bat on which the grip 1*b* of the bat body I is inserted into the grip cover 2 by applying suitable adhesives, as illustrated in FIG. 4, numeral 3 represents a pin or cotter penetrated through the end 1*b'* of the grip 1*b* and the grip end 2*b* of the grip cover 2 so as to form T-shape vertical to the axis of the grip 1*b*. The process of penetrating with the pin 3 comprises placing the grip end 2*b* onto the end 1*b'* of the grip 1*b*, drilling a penetrating hole 4, and pressing the pin into the penetrating hole 4.

A penetrating hole 2*b'*, having a suitable diameter to put in a suitable calking tool 5, is drilled on the surface of the grip end 2*b*. The pin 3 is calked, by means of calking tool 5 at a place adjacent to the inner wall of the grip 1*b* to prevent removal.

Therefore, by penetrating and calking the pin, the metallic bat of the present invention can avoid the disadvantage of conventional metallic bats that the grip is removed to fly out from the grip cover to cause unforeseen accidents on swinging the bat. Thus, it is possible to provide a safe and functional metallic bat.

What is claimed is:

1. In a hollow tubular metallic bat having a grip cover made of hard rubber or the like covering the grip of the bat, said grip cover having an enlarged grip end, the improvement whereby the grip of the bat is prevented from flying out of the grip cover upon swinging of the bat, comprising:

at least one pin or cotter penetrating through said grip end of said grip cover and said grip and wherein said pin or cotter is calked to the inside wall of said grip.

2. A bat in accordance with claim 1 wherein said grip cover has a hole therein in the extreme end thereof covering the open end of said grip, for allowing calking of said pin or cotter to said inside wall.

* * * * *